US009377732B2

(12) United States Patent
Hirose et al.

(10) Patent No.: US 9,377,732 B2
(45) Date of Patent: Jun. 28, 2016

(54) FIXING APPARATUS

(71) Applicant: CANON KABUSHIKI KAISHA, Tokyo (JP)

(72) Inventors: Masaki Hirose, Suntou-gun (JP); Satoru Taniguchi, Mishima (JP); Taisuke Minagawa, Suntou-gun (JP); Yuji Fujiwara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/713,893

(22) Filed: May 15, 2015

(65) Prior Publication Data

US 2015/0338803 A1 Nov. 26, 2015

(30) Foreign Application Priority Data

May 21, 2014 (JP) ..... 2014-105591

(51) Int. Cl.
*G03G 15/20* (2006.01)

(52) U.S. Cl.
CPC ..... *G03G 15/2053* (2013.01)

(58) Field of Classification Search
CPC combination set(s) only.
See application file for complete search history.

(56) References Cited

U.S. PATENT DOCUMENTS

| | | | | |
|---|---|---|---|---|
| 2002/0011475 | A1* | 1/2002 | Haneda et al. | 219/216 |
| 2003/0042241 | A1* | 3/2003 | Uekawa et al. | 219/216 |
| 2008/0273904 | A1* | 11/2008 | Nishida et al. | 399/333 |

FOREIGN PATENT DOCUMENTS

| | | | | |
|---|---|---|---|---|
| JP | 2003-007435 A | | 1/2003 | |
| JP | 2003-007435 A | * | 1/2003 | G03G 15/20 |
| JP | 2003-317898 A | | 11/2003 | |
| JP | 2006-267410 A | | 10/2006 | |
| JP | 2014-055104 A | | 3/2014 | |

* cited by examiner

*Primary Examiner* — Clayton E Laballe
*Assistant Examiner* — Jas Sanghera
(74) *Attorney, Agent, or Firm* — Canon USA, Inc., IP Division

(57) ABSTRACT

On a second surface of a contact member opposite to a first surface in contact with an endless film, a plurality of sheets, each having a thermal conductivity in a planar direction higher than in a thickness direction and having a thickness of less than 100 μm, are superposed.

6 Claims, 10 Drawing Sheets

FIXING APPARATUS

BACKGROUND OF THE INVENTION

1. Field of the Invention

The present invention relates to a fixing apparatus for heating a recording material bearing an unfixed image to fix the unfixed image onto the recording material.

2. Description of the Related Art

A certain fixing apparatus mounted on an image forming apparatus, such as a copying machine and a printer, includes an endless film, a ceramic heater in contact with the inner surface of the endless film, and a pressing roller for forming a fixing nip portion with the ceramic heater via the endless film. When an image forming apparatus mounting this fixing apparatus performs continuous printing on small-size paper, a phenomenon of gradual temperature rise occurs at areas in a longitudinal direction of the fixing nip portion through which paper does not pass (this phenomenon is referred to as temperature rise at the sheet non-passing portions). If the temperature of the sheet non-passing portions rises too high, each part in the apparatus may be damaged. If printing is performed on large-size paper in a state of temperature rise at the sheet non-passing portions, a phenomenon in which toner at areas corresponding to the sheet non-passing portions for small-size paper is excessively heated and offset onto the film may arise (this phenomenon is referred to as high-temperature offsetting).

As a method for suppressing temperature rise at the sheet non-passing portions, a method for providing a ceramic heater with a member having thermal conduction anisotropy, represented by a graphite sheet is proposed (Japanese Patent Application Laid-Open No. 2003-317898 and Japanese Patent Application Laid-Open No. 2003-007435). Graphite has a structure in which hexagonal plate crystals composed of carbon are combined in layer form, and layers are combined by the Van der Waals' forces. Graphite provides high thermal conductivity in a direction parallel to the plane of the ceramic heater (in a direction parallel to the plane of covalent bond layers of graphite). Therefore, temperature rise at the sheet non-passing portions for small-size paper can be prevented by providing a graphite sheet on a ceramic substrate. Hereinafter, a member having thermal conduction anisotropy, such as a graphite sheet, is referred to as a heat leveling sheet. As discussed in Japanese Patent Application Laid-Open No. 2014-055104, a graphite sheet having high thermal conductivity in a direction parallel to the sheet plane is manufactured through heat processing on a polyimide film, which is a raw material.

The amount of heat transport of the heat leveling sheet in a planar direction of the heat leveling sheet(in a direction parallel to the sheet plane) can be obtained by multiplying the thermal conductivity in a planar direction of the heat leveling sheet by the thickness of the heat leveling sheet. To increase the amount of heat transport of a sheet to heighten the effect of suppressing temperature rise at the sheet non-passing portions, it is necessary to increase the thermal conductivity in a planar direction of the heat leveling sheet or to increase the thickness of the heat leveling sheet.

However, there have been the following problems that arise if a thick graphite sheet is to be disposed on the back side of the ceramic heater.

As a first problem, it is harder to manufacture a thick graphite sheet than to manufacture a thin graphite sheet while maintaining high thermal conductivity in a direction parallel to the sheet plane. Therefore, an effect of reducing temperature rise at the sheet non-passing portions by a thick graphite sheet is not so large as expected.

To manufacture a sheet having high thermal conductivity in a direction parallel to the sheet plane, a uniform molecular orientation is important. Processes for acquiring this characteristic include selecting a material having high molecular orientation from among polyimide films, which are raw materials, and applying a voltage to a graphite sheet in the manufacturing process. In this way, many processes are required to manufacture a thick graphite sheet. For this reason, many commercial graphite sheets having thermal conductivity exceeding 1000 W/(m·K) have a thickness of less than 100 μm.

As a second problem, the first printout time (FPOT) of an image forming apparatus is prolonged. The FPOT refers to a time period since a print signal is transmitted to a printer until the first sheet of recording material is discharged from the printer. To shorten the FPOT, it is necessary to use members having low heat capacity in the fixing apparatus. However, increasing the thickness of a graphite sheet increases the heat capacity of the sheet, resulting in an increase in heat capacity of the entire fixing apparatus. Further, the thermal conductivity of a graphite sheet in the thickness direction is sufficiently lower than that in a direction parallel to the sheet plane, but is higher than that of a heater holder which supports the ceramic heater. Therefore, the heat of the ceramic heater easily radiates to the heater holder, degrading the efficiency of heat supply to a recording material.

SUMMARY OF THE INVENTION

The present invention is directed to configuring a fixing apparatus for suppressing temperature rise at the sheet non-passing portions without degrading the FPOT. The present invention is further directed to providing a fixing apparatus including an endless film, a contact member configured to contact an inner surface of the endless film, and a nip portion forming member configured to form a nip portion with the contact member via the endless film. A recording material bearing an unfixed image is heated while being pinched and conveyed by the nip portion, and the unfixed image on the recording material is heated and fixed onto the recording material. On a second surface of the contact member opposite to a first surface in contact with the endless film, a plurality of sheets, each having a thermal conductivity in a planar direction higher than in a thickness direction and having a thickness of less than 100 μm, are superposed.

Further features of the present invention will become apparent from the following description of exemplary embodiments with reference to the attached drawings.

DESCRIPTION OF THE EMBODIMENTS

Exemplary embodiments of the present invention will be described in detail below with reference to the accompanying drawings. However, sizes, materials, shapes, and relative arrangements of elements described in these exemplary embodiments are not limited thereto, and should be modified as required depending on the configuration of an apparatus according to the present invention and other various conditions. The scope of the present invention is not limited to the exemplary embodiments described below.

(1) Image Forming Apparatus

Figure 1:
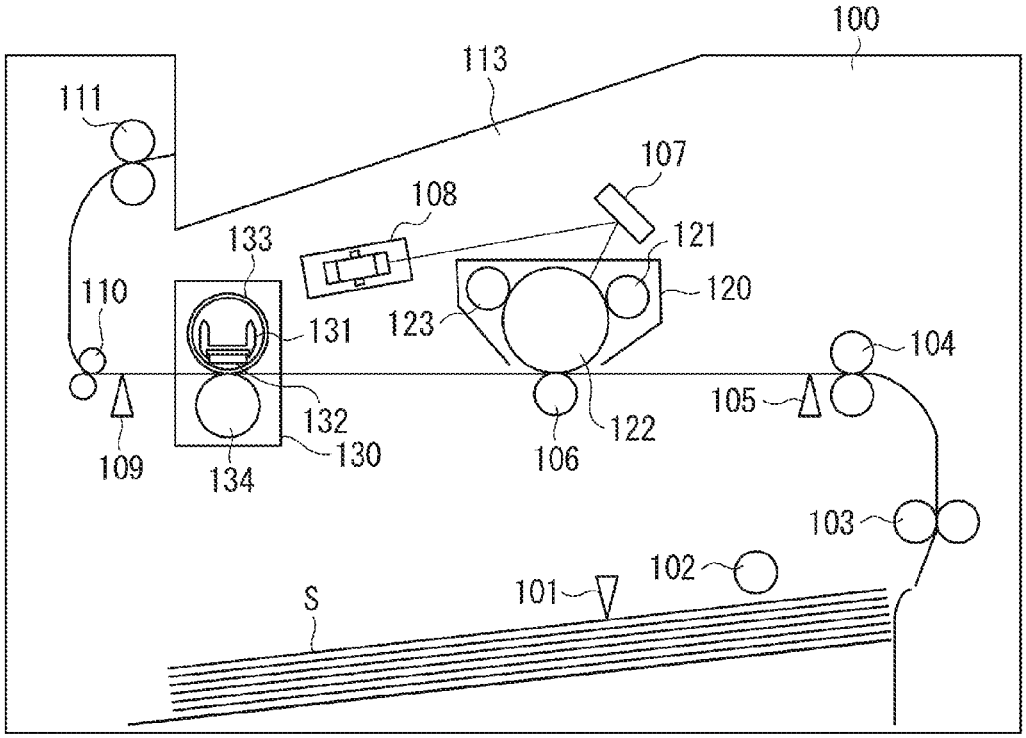
FIG. 1 is a sectional view schematically illustrating a configuration of an image forming apparatus according to a first exemplary embodiment.

A first exemplary embodiment will be described below. FIG. 1 is a sectional view schematically illustrating a configuration of an image forming apparatus according to the present exemplary embodiment. An overall configuration and printing operations (image forming operations) of the image forming apparatus will be described below with reference to FIG. 1.

As illustrated in FIG. 1, an image forming apparatus 100 according to the present exemplary embodiment includes a toner cartridge 120 which is detachably attached to the main unit of the image forming apparatus 100. The toner cartridge 120 includes a developing roller 121, a photosensitive drum 122, and a charging roller 123.

When printing operation is started, the photosensitive drum 122 is uniformly charged to a predetermined potential by the charging roller 123. The charged surface of the photosensitive drum 122 is irradiated with laser light emitted from a laser optical box 108 and reflected by a laser light reflection mirror 107. This laser light is modulated (converted to an ON/OFF state) corresponding to a time-series electrical digital pixel signal corresponding to target image information input from an image signal generation apparatus (not illustrated), such as an image scanner and a computer.

When scanning is performed by irradiating the photosensitive drum 122 with laser light, a latent image (electrostatic latent image) corresponding to the image information is formed on the surface of the photosensitive drum 122. The latent image corresponding to the target image formed in this way is developed by the developing roller 121.

Subsequently, when a recording material existence sensor 101 detects that a recording material is present in a sheet feeding cassette, a recording material S is fed from the sheet feeding cassette by a feeding roller 102, and then is conveyed by a conveyance roller 103 and a registration roller 104. In this process, the leading edge of the recording material S is detected by a top sensor 105, and accordingly the recording material S is conveyed to a nip portion between the photosensitive drum 122 and a transfer roller 106 in synchronization with a toner image formed on the photosensitive drum 122.

The transfer roller 106 supplies charges having a polarity opposite to the normal charging polarity of toner from the rear surface of the recording material S to transfer the toner image from the photosensitive drum 122 onto the recording material S. After the toner image is thus transferred onto the recording material S, the recording material S is separated from the photosensitive drum 122 and then is fed to a fixing apparatus 130 as an image heating apparatus. In the fixing apparatus 130, the recording material S is pinched and conveyed by the nip portion, and the unfixed toner image is heated and pressed to be fixed onto the recording material S.

A discharge sensor 109 detects the passage of the leading edge of the recording material S having the toner image fixed thereon. The recording material S is conveyed by a roller 110 and a roller 111 and then is discharged onto a face-down (FD) tray 113. This completes a series of printing operations.

According to the specifications, the image forming apparatus according to the present exemplary embodiment has a process speed of 350 mm/sec., a throughput of 60 ppm in longitudinal sheet passing with A4-size paper, and a FPOT of 7.0 seconds.

(2) Fixing Apparatus

Figure 2:
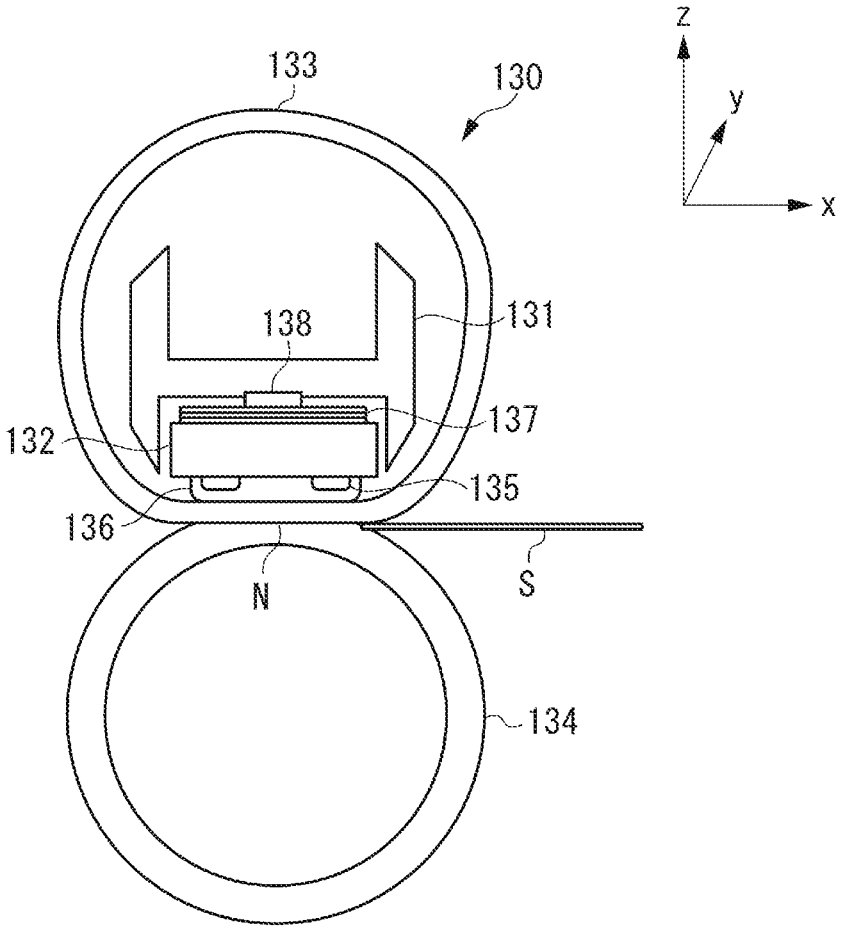
FIG. 2 is a sectional view schematically illustrating a configuration of a fixing apparatus of film heating type according to the first exemplary embodiment.

The fixing apparatus 130 according to the present exemplary embodiment will be described below. FIG. 2 is a sectional view schematically illustrating a configuration of the fixing apparatus 130 of a film heating type according to the present exemplary embodiment. The fixing apparatus 130 includes an endless film 133 and a contact member (a heater 132 in the present exemplary embodiment) in contact with the inner surface of the endless film 133. The fixing apparatus 130 further includes a nip portion forming member (a pressing roller 134 in the present exemplary embodiment) for forming a nip portion N for pinching and conveying the recording material S bearing an unfixed image together with the contact member via the endless film 133. At the nip portion N, the unfixed image is heated and fixed onto the recording material S. A holding member 131 (a heater holder 131 for holding the heater 132 in the present exemplary embodiment) holds the contact member. A heat leveling sheet 137 (a sheet having thermal conduction anisotropy) is disposed on a second surface of the contact member opposite to a first surface in contact with the endless film 133. In the fixing apparatus 130, a biasing spring (not illustrated) presses a portion between the heater holder 131 and the pressing roller 134 to form the nip portion N. Therefore, the heat leveling sheet 137 is sandwiched and pressed by the heater 132 and the heater holder 131.

(2-1) Heater Holder 131

The heater holder 131, a member formed by a heat-resistant resin, supports the heater 132 and the heat leveling sheet 137. The heater holder 131 according to the present exemplary embodiment serves also as a conveyance guide for the endless film 133. The heater holder 131 can be composed of a highly processable and highly heat-resistant resin (polyimide, polyamide-imide, polyetheretherketone, polyphenylenesulphide, a liquid crystal polymer, etc.), or a composite material made of the highly processable and highly heat-resistant resin and ceramic, metal, or glass. A liquid crystal polymer is used in the present exemplary embodiment.

(2-2) Heater 132

The heater 132 is a ceramic heater. A heater substrate is a ceramic substrate having high thermal conductivity and insulation performance made of ceramic, such as alumina or aluminum nitride. The ceramic substrate (hereafter referred to as a substrate) suitably has a thickness of about 0.5 to 1.0 mm to decrease the heat capacity, and is formed in a rectangular shape of about 10 mm in width and about 300 mm in length.

A resistance heating element 135 is formed along the longitudinal direction on one surface (front surface) of the heater substrate. The resistance heating element 135 is made mainly of a silver palladium alloy, a nickel tin alloy, a ruthenium oxide alloy, etc., and is formed at about 10 μm in thickness and about 1 to 5 mm in width through screen printing. An insulating glass 136 is overcoated as an electric insulating layer on the upper part of the heater substrate and the resistance heating element 135. The insulating glass 136 not only ensures the insulation performance between the resistance heating element 135 and an external conductive member (a conductive layer of the endless film 133) but also prevents mechanical damage. The insulating glass 136 suitably has a thickness of about 20 to 100 μm. The insulating glass 136 also serves as a sliding layer which slides with the endless film 133.

(2-3) Heat-resistant Film 133

The endless film 133 is externally fitted to the heater holder 131 for holding the ceramic heater 132. The endless film 133 is disposed such that its inner circumference length is larger than the outer circumference length of the heater holder 131 for supporting the ceramic heater 132. Therefore, the endless film 133 is externally fitted to the heater holder 131, with a sufficient inner circumference length.

The endless film 133 efficiently applies the heat of the ceramic heater 132 to the recording material S at the nip portion N. To accomplish this, a heat-resistant monolayer film, such as polytetrafluoroethylene (PTFE), tetrafluoroetylene-perfluoroalkylvinylether copolymer (PFA), and tetrafluoroetylene-hexafluoropropylen copolymer (FEP), or a compound layer film, which has a 20- to 70-μm film thickness is usable as the endless film 133. The compound layer film is composed of a base layer made of polyimide, polyamide-imide, polyetheretherketone (PEEK), polyethersulfone (PES), polyphenylene sulfide (PPS), or steel use stainless (SUS). The compound layer film is further composed of an elastic layer on the outer circumference of the base layer. The elastic layer is made of a material mixing an elastic material, such as silicone rubber, aiming for improving the fixability with a thermal conduction filler, such as ZnO, $Al_2O_3$, SiC, and metal silicon. The compound layer film is coated with PTFE, PFA, FEP, etc. as an outermost layer. In the present exemplary embodiment, the base layer is made of polyimide which is made conductive by a mixed filler with a 40-μm film thickness, the elastic layer is made of silicone rubber with a 240-μm thickness with a mixed thermal conduction filler, and the outermost layer is made of PTFE coated on the elastic layer.

(2-4) Pressing Roller 134

The pressing roller 134, as a nip portion forming member, forms the nip portion N together with the ceramic heater 132 via the endless film 133 and rotatably drive the endless film 133. The pressing roller 134 is an elastic roller composed of a metal core and an elastic layer formed on the outer circumference side of the metal core. The metal core is made of steel use stainless (SUS), steel use machinerbility (SUM), or aluminum (Al). The elastic layer is made of heat-resistant rubber, such as silicone rubber and fluororubber, or foamed silicone rubber. In the pressing roller 134, a mold-release layer made of PFA, PTFE, or FEP may be formed on the elastic layer. In the present exemplary embodiment, the pressing roller 134 is composed of an aluminum core, an elastic layer made of silicone rubber with a 4.0-mm thickness, and a mold-release layer made of PFA with a 50-μm thickness.

(2-5) Heat Leveling Sheet 137

The heat leveling sheet 137 is disposed on the second surface of the ceramic heater 132 opposite to the first surface side of the ceramic heater 132 on which the nip portion N is formed. The heat leveling sheet 137 is made of a material having thermal conduction anisotropy and a thickness of less than 100 μm in which the thermal conductivity in a sheet planar direction perpendicular to the thickness direction is higher than that in the thickness direction. In the present exemplary embodiment, three sheets are superposed. Each of the heat leveling sheet 137 is made of graphite and having a thickness of less than 100 μm. Graphite has a structure in which hexagonal plate crystals composed of carbon are combined in layer form, and layers are combined by the Van der Waals' forces. Because of such a structure, graphite provides very high thermal conductivity in a planar direction of the sheet (in a direction parallel to the sheet plane). However, the thermal conductivity in a direction perpendicular to the sheet plane is lower than that in a direction parallel to the sheet plane. Referring to FIG. 2, a direction x refers to a direction parallel to the conveyance direction of the recording material S (=the widthwise direction of the ceramic heater 132) at the nip portion N, a direction y refers to a direction parallel to the sheet plane of the recording material S and perpendicular to the conveyance direction of the recording material S (=the longitudinal direction of the ceramic heater 132), and a direction z refers to a direction perpendicular to the conveyance direction of the recording material S.

As illustrated in FIG. 2, the graphite sheet 137 is disposed between the heater holder 131 and the ceramic heater 132. According to the present exemplary embodiment, one graphite sheet is 40-μm thick, and provides thermal conductivity of 1500 W/(m·K) in a direction parallel to the sheet plane and 5 to 10 W/(m·K) in the thickness direction (a direction perpendicular to the sheet plane). In the present exemplary embodiment, no adhesive is used between the ceramic heater 132 and the graphite sheet 137 or between graphite sheets. The graphite sheet 137 (3 sheets) is simply sandwiched by the heater holder 131 and the ceramic heater 132.

(2-6) Thermistor 138

A thermistor 138 is an element for detecting the temperature of the longitudinal central portion of the ceramic heater 132. The temperature detected by the thermistor 138 is input to an engine controller (not illustrated). The thermistor 138 is a negative temperature coefficient (NTC) thermistor of which the resistance value decreases with increasing temperature. The engine controller monitors the temperature of the ceramic heater 132, and adjusts power to be supplied to the ceramic heater 132 by comparing the detected temperature with a target temperature set in the engine controller. Power to be supplied to the ceramic heater 132 is controlled in this way such that the ceramic heater 132 maintains the target temperature.

(3) Positional Relation in Longitudinal Direction

Figure 3:
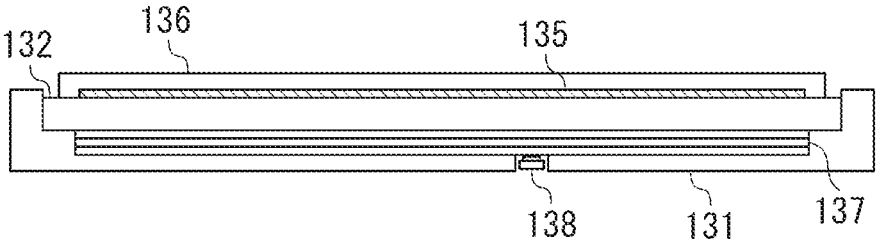
FIG. 3 is a sectional view (1) illustrating a heat leveling sheet arrangement according to the first exemplary embodiment.

FIG. 3 is a sectional view illustrating the inside of the endless film 133 in the longitudinal direction of the fixing apparatus 130 (=the longitudinal direction of the ceramic heater 132) according to the present exemplary embodiment. The resistance heating element 135 is, for example, 222 mm in longitudinal length. This length is determined by the length necessary to satisfy the fixability at the paper ends at the time of sheet passing with paper having the maximum size in the longitudinal direction of the fixing apparatus 130.

On the other hand, the graphite sheet 137 is, for example, 224 mm in longitudinal length. A concept for determining the relevant length will be described below. Although a graphite sheet has an effect of suppressing temperature rise at the sheet non-passing portions during continuous sheet passing, there has been a problem that the temperature of the member's ends tends to decrease when a small number of sheets are printed.

For example, if the graphite sheet 137 is extremely long relative to the resistance heating element 135, the effect of suppressing temperature rise at the sheet non-passing portions increases but temperature fall at the member's ends easily occurs. Conversely, if the resistance heating element 135 and the graphite sheet 137 have the same length, the heat of the sheet non-passing portions cannot be sufficiently released toward the member's ends, reducing the effect of suppressing temperature rise at the sheet non-passing portions. Therefore, it is necessary to determine the length of the graphite sheet 137 while balancing the relevant two factors. Generally, it is preferable that the graphite sheet 137 is slightly longer than the heating element 135 of the ceramic heater 132.

(4) About Superposition of Heat Leveling Sheets

The thinner a graphite sheet, the higher the thermal conductivity in a direction parallel to the sheet plane. The thicker a graphite sheet, the lower the thermal conductivity. The present exemplary embodiment utilizes such thermal conduction characteristics. More specifically, since a thin graphite sheet is used, the present exemplary embodiment provides high thermal conductivity in a direction parallel to the sheet plane, resulting in a large amount of heat transport. Further, since graphite sheets are superposed, air layers can be inserted between sheets. The air layers serve as heat insulating layers having an effect of suppressing heat transfer in a direction perpendicular to the graphite sheet plane. As a result, it becomes hard to radiate heat to the heater holder 131, and easy to transfer heat to the paper. Therefore, in comparison with the fixing apparatus 130 configured with one graphite sheet, the fixing apparatus 130 according to the present exemplary embodiment achieves equivalent fixability and equivalent FPOT in a case where the fixing apparatus 130 has not been sufficiently warmed up. Further, since the air layers serve as heat insulating layers, the fixing apparatus 130 according to the present exemplary embodiment is assumed to be capable of providing temperature fall at the member's ends equivalent to the fixing apparatus 130 configured with only one graphite sheet.

Also when suppressing temperature rise at the sheet non-passing portions, the air layers serve as heat insulating layers. However, since the temperature of the sheet non-passing portions gradually increases during continuous printing, the heat can be gradually transferred also in a direction perpendicular to the graphite sheet. Therefore, graphite sheets provides a large amount of heat transport, and therefore suppresses temperature rise at the sheet non-passing portions.

In the present exemplary embodiment, no other members are inserted between graphite sheets. However, within a range in which the above-described performance is satisfied, a small amount of a member having thermal conductivity lower than that of a graphite sheet in the thickness direction may be inserted between graphite sheets. We performed the following experiments to confirm the above-described effects.

<Experiment 1>

In this experiment, we investigated about temperature rise at the sheet non-passing portions during continuous sheet passing with small-size paper. We used the main unit of the image forming apparatus 100 according to the present exemplary embodiment. We prepared the fixing apparatus 130 according to the present exemplary embodiment which is provided with 2 to 3 superposed graphite sheets on the back side of the ceramic heater 132. Further, for the purpose of comparison, we prepared a total of 9 different types of fixing apparatuses, including a type which has different thermal conductivity and different thicknesses of graphite sheets, a type which uses copper heat leveling sheets, and a type which uses no heat leveling sheet. In measurement of temperature rise at the sheet non-passing portions, we obtained a difference between the temperatures of the central portion and the ends of the endless film 133. More specifically, we checked how much the temperature of the ends of the endless film 133 became higher than the temperature of the central portion thereof. The recording material S used for sheet passing is A4-size paper with a 80-g/m$^2$ grammage (basis weight). We performed continuous sheet passing by using a total of 200 sheets. A thermo-tracer made by NEC corporation was used for measuring the surface temperature of the endless film 133.

Table 1 illustrates experimental conditions and results. In an experiment according to an exemplary embodiment 1-2 and a comparative example 5, we arranged 2 graphite sheets having different thicknesses so that a thinner graphite sheet was arranged on the side closer to the ceramic heater 132.

TABLE 1

| Condition | Heat leveling member | Thermal conductivity W/(m · K) | Thickness (μm) | Number of sheets | Temperature difference (degrees) |
|---|---|---|---|---|---|
| Exemplary embodiment 1-1 | Graphite | 1500 | 40 + 40 + 40 | 3 in total | 32.3 |
| Comparative example 1 | Graphite | 1500 | 40 | 1 | 48.7 |
| Comparative example 2 | Graphite | 1300 | 80 | 1 | 43.2 |
| Comparative example 3 | Graphite | 800 | 100 | 1 | 47.3 |
| Comparative example 4 | Graphite | 500 | 120 | 1 | 49.4 |
| Exemplary embodiment 1-2 | Graphite | 1500, 1300 | 40 + 80 | 2 in total | 36.3 |
| Comparative example 5 | Graphite | 1500, 800 | 20 + 100 | 2 in total | 44.8 |
| Comparative example 6 | Copper | 427 | 120 | 1 | 51.7 |
| Comparative example 7 | None | — | — | — | 63.4 |

As a result of the experiment, an exemplary embodiment 1-1 considered to provide the largest amount of heat transport had a largest effect of suppressing temperature rise at the sheet non-passing portions. This result means that superposing a plurality of thin graphite sheets having high thermal conductivity in the longitudinal direction provides a large effect of suppressing temperature rise at the sheet non-passing portions. In particular, we confirmed that the present exemplary embodiment configured with a plurality of superposing graphite sheets each having a thickness of less than 100 μm and thermal conductivity in the planar direction of 1000 W/(m·K) or higher provided a large effect of suppressing temperature rise at the sheet non-passing portions.

<Experiment 2>

In this experiment, we checked whether superposing graphite sheets degrades the FPOT or temperature fall at the member's ends (film's ends). We used the main unit of the image forming apparatus 100 according to the present exemplary embodiment. We prepared the fixing apparatus 130 according to the present exemplary embodiment and fixing apparatuses for comparison having different heat leveling sheet conditions.

The recording material S used for sheet passing is LTR-size paper with a 75 g/m$^2$ grammage. We performed printing on a sheet by using each fixing apparatus which has been left at normal temperature and sufficiently cooled down. We performed sheet passing in this way, and checked what FPOT (seconds) is necessary to satisfy the fixability. Further, we measured a difference between the temperatures of the central portion and the ends of the endless film 133 immediately before the recording material S enters the fixing apparatus 130. The larger the relevant temperature difference, the lower the temperature of the ends has fallen. At the same time, we sent the recording material on which an unfixed solid image is formed and also checked the fixability at the ends of the image. A thermo-tracer made by NEC corporation was used for measuring the surface temperature of the endless film 133. Table 2 illustrates experimental conditions and results.

TABLE 2

| Condition | Heat leveling member | Thermal conductivity W/(m · K) in planar direction | Thermal conductivity W/(m · K) in thickness direction | Thickness (μm) | Number of sheets |
|---|---|---|---|---|---|
| Exemplary embodiment 1-1 | Graphite | 1500 | 5 to 10 | 40 + 40 + 40 | 3 in total |
| Comparative example 1 | Graphite | 1500 | 5 to 10 | 40 | 1 |
| Comparative example 2 | Graphite | 1300 | 5 to 10 | 80 | 1 |
| Comparative example 3 | Graphite | 800 | 5 to 10 | 100 | 1 |
| Comparative example 4 | Graphite | 500 | 5 to 10 | 120 | 1 |
| Exemplary embodiment 1-2 | Graphite | 1500, 1300 | 5 to 10 | 40 + 80 | 2 in total |
| Comparative example 5 | Graphite | 1500, 800 | 5 to 10 | 20 + 100 | 2 in total |
| Comparative example 6 | Copper | 427 | 427 | 120 | 1 |
| Comparative example 7 | None | — | — | — | — |

| Condition | FPOT (seconds) | Temperature difference (degrees) | Fixability at ends |
|---|---|---|---|
| Exemplary embodiment 1-1 | 7.0 | 23.8 | ○ |
| Comparative example 1 | 7.0 | 23.6 | ○ |
| Comparative example 2 | 7.3 | 26.1 | Δ |
| Comparative example 3 | 8.0 | 27.8 | Δ |
| Comparative example 4 | 8.0 | 28.2 | Δ |
| Exemplary embodiment 1-2 | 7.0 | 24.3 | ○ |
| Comparative example 5 | 7.2 | 25.3 | Δ |
| Comparative example 6 | 8.5 | 32.4 | x |
| Comparative example 7 | 7.0 | 20.4 | ○ |

In this experiment, we confirmed that the fixing apparatus 130 having 3 superposed graphite sheets according the exemplary embodiment 1-1 provided a FPOT similar to that of the fixing apparatus 130 according to a comparative example 1, and that temperature fall at the member's ends was suppressed. The copper used in a comparative example 6 did not have thermal conduction anisotropy. Therefore, when copper was employed as the heat leveling sheets, the thermal conductivity of the sheet in a thickness direction of the sheet also increases. As a result, since the heat easily radiates to the heater holder 131, the fixability degrades. Accordingly, the FPOT according to the comparative example 6 was longer than that according to the exemplary embodiment 1-1. This result means that superposing a plurality of thin graphite sheets each having high thermal conductivity in the longitudinal direction provides a small effect of degrading the FPOT and temperature fall at the member's ends.

According to the above-described results, by superposing thin heat leveling sheets, air layers are inserted between the heat leveling sheets so that it is possible to minimize the effects on the warm-up of the ceramic heater 132 and temperature fall at the member's ends. Further, during continuous printing, since the sheet non-passing portions have a very high temperature, the heat can be gradually transferred to enable uniforming the temperatures of the sheet-passing and the sheet non-passing portions of the film. Thus, this method has a large effect of suppressing temperature rise at the sheet non-passing portions.

It is demanded that, during continuous printing, the difference between the temperatures of the sheet-passing and the sheet non-passing portions of the endless film 133 is 40 degrees or lower. This means that it is desirable to superpose graphite sheets each having a thickness of less than 100 μm. A graphite sheet having a thickness of 100 μm or more provides lower thermal conductivity in the sheet planar direction than a graphite sheet having a thickness of less than 100 μm. Therefore, superposing such thick graphite sheets does not increase the thermal conductivity in the sheet planar direction, but degrades the effect of suppressing temperature rise at the sheet non-passing portions.

Figure 4:
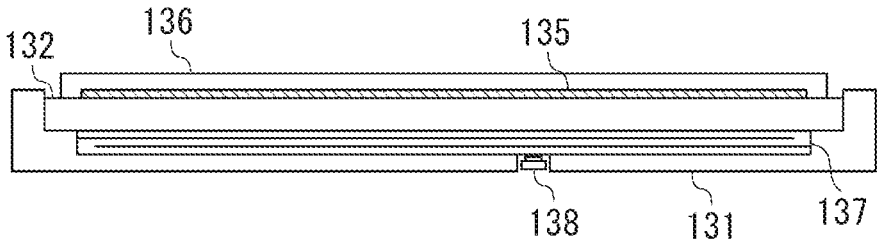
FIG. 4 is a sectional view (2) illustrating a heat leveling sheet arrangement according to the first exemplary embodiment.

Although, in the above-described examples, the object is achieved by superposing at least 2 graphite sheets, sheet superposition may be implemented by folding one graphite sheet, as illustrated in FIG. 4. This case has an advantage that the number of parts can be reduced in comparison with the above-described exemplary embodiments.

Figure 5:
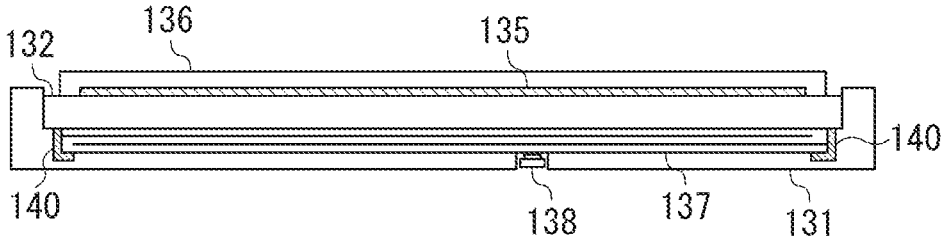
FIG. 5 is a sectional view (3) illustrating a heat leveling sheet arrangement according to the first exemplary embodiment.

In the above-described case where one graphite sheet is folded, since a high pressure is also applied to folded portions, there is a concern that the graphite sheet may be broken. Accordingly, it is necessary to form air layers 140 outside the portion pressed by the ceramic heater 132 and the heater holder 131, and fold the graphite sheet at the portions of the air layers 140, as illustrated in FIG. 5.

Figure 6:
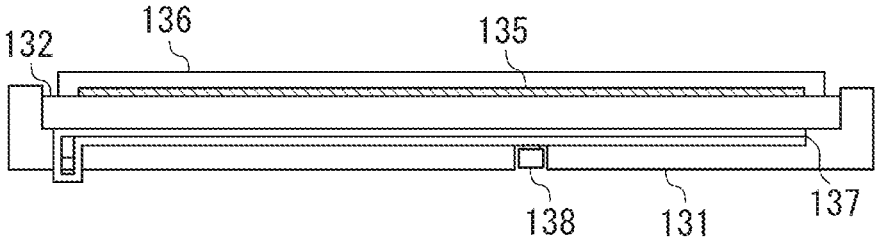
FIG. 6 is a sectional view (4) illustrating a heat leveling sheet arrangement according to the first exemplary embodiment.

Further, when folding the graphite sheet at a portion outside the pressed portion, the graphite sheet may be folded via the heater holder 131, as illustrated in FIG. 6. If the sheet is in contact with the heater holder 131 at a portion outside the pressed portion, as much heat as possible can be released toward the heater holder 131 when the temperature of the sheet non-passing portions rises.

Figure 7:
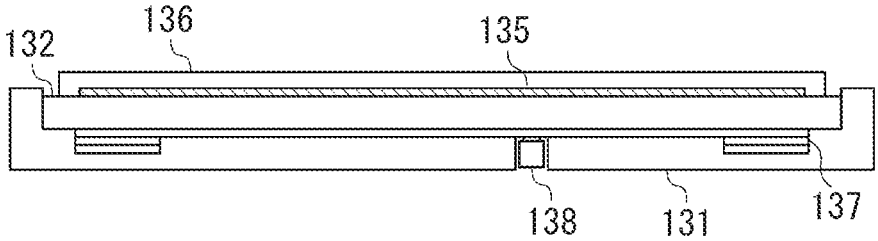
FIG. 7 is a sectional view (1) illustrating a heat leveling sheet arrangement according to a second exemplary embodiment.

Basic configurations of the image forming apparatus 100 and the fixing apparatus 130 according to a second exemplary embodiment are similar to those according to the first exemplary embodiment. Identical components are assigned the same reference numeral and redundant descriptions will be omitted. FIG. 7 is a sectional view illustrating the inside of the endless film 133 in the longitudinal direction of the fixing apparatus 130 (=the longitudinal direction of the ceramic heater 132) according to the present exemplary embodiment.

The second exemplary embodiment differs from the first exemplary embodiment in that the number of superposed heat leveling sheet layers differs between the longitudinal central portion and the longitudinal ends of the contact member (the ceramic heater 132). To reduce temperature rise at the sheet non-passing portions, it is only necessary to release, at the longitudinal ends, as much heat as possible toward the sides of the sheet-passing portion and the longitudinal ends.

Although, in the first exemplary embodiment, 3 graphite sheets are superposed over the entire longitudinal range, the range is not limited thereto. It is only necessary that 3 graphite sheets are superposed at portions ranging from the sheet-passing portion to the longitudinal ends. As a result, the heat of the sheet non-passing portions is released toward the sides of the sheet-passing portion and the longitudinal ends, which enables temperature fall at the sheet non-passing portions. Further, the present exemplary embodiment requires less amount of used graphite sheet than the first exemplary embodiment, resulting in cost reduction.

Figure 8A:
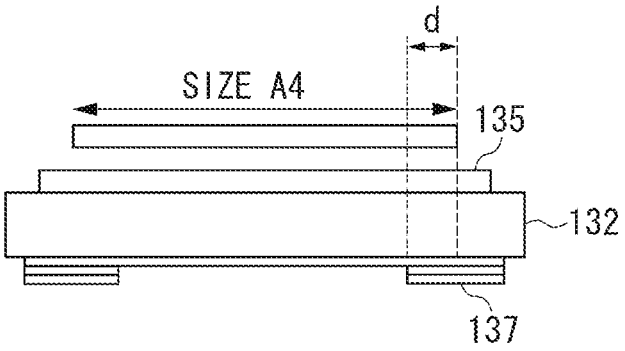
FIGS. 8A and 8B illustrate positional relations between a recording material and heat leveling sheets according to the second exemplary embodiment.
Figure 8B:
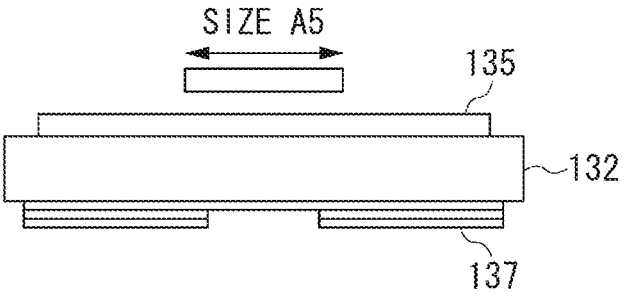

FIGS. 8A and 8B illustrate examples of cases where a larger number of graphite sheet layers are superposed at the ends than at the central portion. FIG. 8A illustrates an example which targets temperature rise at the sheet non-passing portions during longitudinal sheet passing with A4-size paper. FIG. 8B illustrates an example which targets temperature rise at the sheet non-passing portions during longitudinal sheet passing with A5-size paper. Thus, one graphite sheet is provided at the central portion and 3 graphite sheets are superposed at portions ranging from the longitudinal ends to the sheet-passing portion. As a result, a larger number of graphite sheet layers are superposed at the ends than at the central portion.

Further, the length of a portion d illustrated in FIG. 8A (a portion at which the sheet superposing portion overlaps with the target paper) will be described below. With a short length of the portion d, since the heat of the sheet non-passing portions is hard to be released to the sheet-passing portion side, the effect of reducing temperature rise at the sheet non-passing portions becomes smaller. This length needs to be determined in consideration of the above-described background. We performed an experiment 3 to obtain an optimal value of the length of the portion d.

<Experiment 3>

In this experiment, we measured changes of temperature rise at the sheet non-passing portions during continuous printing, with different lengths of the portion d. We used the main unit of the image forming apparatus 100 according to the present exemplary embodiment. We prepared a fixing apparatus which is provided with 3 superposed graphite sheets on the back side of the ceramic heater 132 only at the ends and provided with the length of the portion d, and a fixing apparatus which is provided with 3 superposed graphite sheets over the entire longitudinal range for comparison. In measurement of temperature rise at the sheet non-passing portions, we obtained a difference between the temperatures of the central portion and the ends of the endless film 133. The recording material S used for sheet passing is A4-size paper with a 80-g/m$^2$ grammage. We performed continuous sheet passing by using a total of 200 sheets. A thermo-tracer made by NEC corporation was used for measuring the surface temperature of the endless film 133. Table 3 illustrates experimental conditions and results.

TABLE 3

| Condition | d (mm) | Thermal conductivity W/(m · K) | Number of sheets at center | Number of sheets at ends | Temperature difference (degrees) |
|---|---|---|---|---|---|
| Exemplary embodiment 2-1 | 0 | 1500 | 1 | 3 | 44.8 |
| Exemplary embodiment 2-2 | 5 | | | | 37.6 |
| Exemplary embodiment 2-3 | 10 | | | | 32.5 |
| Exemplary embodiment 2-4 | 15 | | | | 32.3 |
| Exemplary embodiment 1 | 222 | | 3 | | 32.3 |

In this experiment, the longer the length of the portion d, the more the thick portion of graphite sheets overlaps with the sheet-passing portion, which possibly provides a large effect of suppressing temperature rise at the sheet non-passing portions. Based on the results of the experiment, we found that, when the length of the portion d is 10 mm or more, there was provided an effect of suppressing temperature rise at the sheet non-passing portions, similar to that in the case where 3 graphite sheets are arranged over the entire longitudinal range.

According to the above-described results, superposing thin graphite sheets only at the longitudinal ends provided an effect of suppressing temperature rise at the sheet non-passing portions, similar to that in the case where sheets are superposed over the entire longitudinal range, while requiring less amount of graphite sheets than the relevant case.

Figure 9:
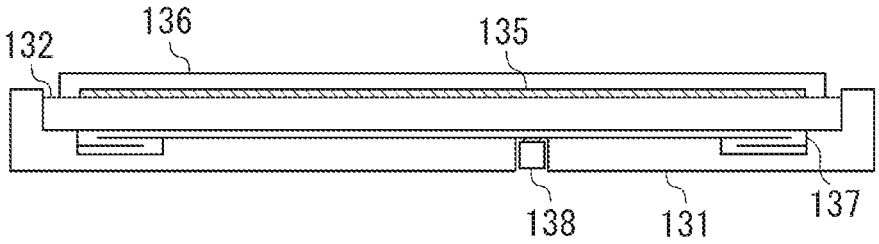
FIG. 9 is a sectional view (2) illustrating a heat leveling sheet arrangement according to the second exemplary embodiment.

Although, in the above-described examples, the object is achieved by superposing at least 2 graphite sheets, a plurality of sheet layers may be superposed by folding. For example, sheet superposition may be implemented only at the ends by folding one graphite sheet, as illustrated in FIG. 9. This case has an advantage that the number of parts can be reduced in comparison with the above-described exemplary embodiments.

Figure 10:
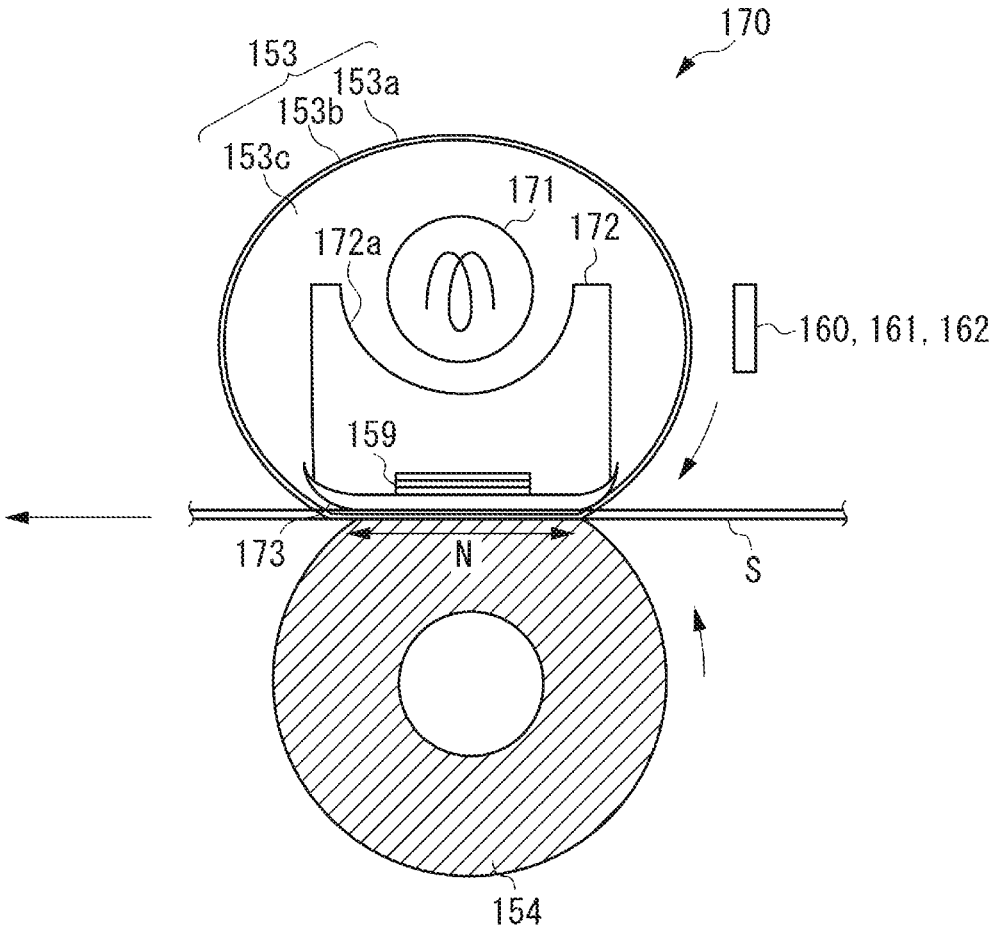
FIG. 10 is a sectional view schematically illustrating a configuration of another fixing apparatus.

In the above-described fixing apparatuses according to the first and second exemplary embodiments, the endless film 133 is sandwiched between the ceramic heater 132 and the pressing roller 134 to form the fixing nip portion N. However, another fixing apparatus may have a configuration as illustrated in FIG. 10. Referring to FIG. 10, a halogen heater 171 heats an endless film 153 without contacting the endless film 153. In the configuration of a fixing apparatus 170, when the halogen heater 171 arranged inside the endless film 153 is turned ON, the halogen heater 171 heats the inner surface of the endless film 153 from inside. A pressing member 172 presses a contact member 173 onto a pressing roller 154. The pressing member 172 is provided with a reflecting portion 172*a* formed thereon for reflecting radiant heat of the halogen heater 171.

Also with the thus-configured fixing apparatus 170, we confirmed that an effect similar to the above-described effects can be acquired by superposing and disposing a plurality of heat leveling sheets 159 on a plane of the contact member 173 opposite to the fixing nip portion N.

As described above, regardless of the heating method, by superposing a plurality of graphite sheets on a plane of the contact member (on the inner surface of the film) opposite to the fixing nip portion N, it is possible to suppress temperature rise at the sheet non-passing portions while ensuring the FPOT and the fixability at the ends.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-105591, filed May 21, 2014, which is hereby incorporated by reference herein in its entirety.

What is claimed is:

1. A fixing apparatus comprising:

an endless film;

a contact member configured to contact an inner surface of the endless film;

a nip portion forming member configured to form a nip portion with the contact member via the endless film; and a supporting member configured to support the contact member, wherein a recording material bearing an unfixed image is heated while being pinched and conveyed by the nip portion, and the unfixed image on the recording material is heated and fixed onto the recording material, and wherein a plurality of sheets, each having a thermal conductivity in a planar direction higher than in a thickness direction and having a thickness of less than 100 μm, are superposed on a surface of the contact member opposite to a surface of the contact member contacting the endless film, are sandwiched between the contact member and the supporting member, and contact both the contact member and the supporting member.

2. The fixing apparatus according to claim 1, wherein the number of the plurality of sheets is different between a longitudinal central portion and longitudinal ends of the contact member.

3. The fixing apparatus according to claim 1, wherein the plurality of the sheets are formed by folding.

4. The fixing apparatus according to claim 1, wherein a material of the sheets is graphite.

5. The fixing apparatus according to claim 1, wherein the contact member is a heater.

6. The fixing apparatus according to claim 1, further comprising a heater configured to heat the endless film.

* * * * *